US008026939B2

(12) United States Patent
Itou

(10) Patent No.: US 8,026,939 B2
(45) Date of Patent: Sep. 27, 2011

(54) OPTICAL PRINTER HEAD AND IMAGE FORMING APPARATUS EQUIPPED WITH THE SAME

(75) Inventor: Yuu Itou, Higashiomi (JP)

(73) Assignee: Kyocera Corporation, Kyoto (JP)

( * ) Notice: Subject to any disclaimer, the term of this patent is extended or adjusted under 35 U.S.C. 154(b) by 170 days.

(21) Appl. No.: 12/521,284

(22) PCT Filed: Dec. 26, 2007

(86) PCT No.: PCT/JP2007/075037

§ 371 (c)(1),
(2), (4) Date: Jun. 25, 2009

(87) PCT Pub. No.: WO2008/081846

PCT Pub. Date: Jul. 10, 2008

(65) Prior Publication Data

US 2010/0092214 A1 Apr. 15, 2010

(30) Foreign Application Priority Data

Dec. 26, 2006 (JP) ..... 2006-350675

(51) Int. Cl.
*B41J 2/435* (2006.01)
*B41J 2/47* (2006.01)

(52) U.S. Cl. ..... 347/237; 347/247

(58) Field of Classification Search ..... 347/247, 347/236–238, 246

See application file for complete search history.

(56) References Cited

U.S. PATENT DOCUMENTS

| | | | | |
|---|---|---|---|---|
| 5,285,217 | A | 2/1994 | Avonts | 346/107 |
| 5,317,344 | A * | 5/1994 | Beaman et al. | 347/237 |
| 7,038,706 | B1 * | 5/2006 | Hiyoshi | 347/238 |
| 2005/0128534 | A1 | 6/2005 | Iwasaki | 358/486 |

FOREIGN PATENT DOCUMENTS

| | | |
|---|---|---|
| JP | 05-201063 | 8/1993 |
| JP | 05-323230 | 12/1993 |
| JP | 07-061035 | 3/1995 |
| JP | 2000-229440 | 8/2000 |
| JP | 2001-328292 | 11/2001 |
| JP | 2002-067371 | 3/2002 |
| JP | 2002067371 A * | 3/2002 |
| JP | 2005-198254 | 7/2005 |

OTHER PUBLICATIONS

Japanese language office action dated Mar. 9, 2010 and its English language translation for corresponding Japanese application 2008552141.

* cited by examiner

*Primary Examiner* — Hai C Pham
(74) *Attorney, Agent, or Firm* — DLA Piper LLP (US)

(57) ABSTRACT

The invention relates to an optical printer head 12 provided with one or a plurality of light emitting element array units 3. The light emitting element array unit 3 is provided with a circuit board 30, a base member 33 supporting the circuit board 30, and a plurality of light emitting elements mounted onto the base member 33 and arranged in a row in main scanning directions M1 and M2. The base member 33 has a lower hygroscopic rate than the circuit board 30. The plurality of light emitting element array units 3 are arranged along the main scanning directions M1 and M2, for example, so that end portions 34 in adjacent light emitting element array units 3 are overlapped with each other in vertical-scanning directions S1 and S2.

14 Claims, 7 Drawing Sheets

OPTICAL PRINTER HEAD AND IMAGE FORMING APPARATUS EQUIPPED WITH THE SAME

CROSS-REFERENCE TO THE RELATED APPLICATIONS

This application is a national stage of international application No. PCT/JP2007/075037 filed on Dec. 26, 2007, which also claims the benefit of priority under 35 USC 119 to Japanese Patent Application No. 2006-350675 filed on Dec. 26, 2006, the entire contents of which are incorporated herein by reference.

TECHNICAL FIELD

The invention relates to an optical printer head used as exposure means of electrophotographic printers or the like, and to an image forming apparatus equipped with the same.

BACKGROUND ART

Some of image forming apparatuses such as electrophotographic printers employ an optical printer head in which a plurality of light emitting elements are arranged as exposure means.

The image forming apparatuses equipped with the optical printer head are adapted to cause the light emitting elements to selectively emit light based on image data, and the light is irradiated through a lens array of the optical printer head to a photoreceptor. An electrostatic latent image is formed onto the surface of the photoreceptor by the light irradiation. The electrostatic latent image formed onto the photoreceptor is changed into a toner image through the process of development using toner, and the like. Then, an image is recorded by transferring and fixing the toner image onto a recording paper.

As the above optical printer head, those in which a plurality of light emitting element array units mounting a plurality of light emitting elements on a circuit board are arranged along a main scanning direction, and the adjacent light emitting element array units are arranged in a zigzag pattern by shifting them in a vertical-scanning direction have been proposed (for example, refer to patent documents 1 and 2).

Patent document 1: Japanese Unexamined Patent Application Publication No. 7-61035

Patent document 2: Japanese Unexamined Patent Application Publication No. 2001-328292

DISCLOSURE OF THE INVENTION

Problems to be Solved by the Invention

In the optical printer heads disclosed in the patent documents 1 and 2, however, a light emitting element array chip is usually mounted on the circuit board composed mainly of a resin material having a relatively high hygroscopic rate. Therefore, in these optical printer heads disclosed in the patent documents 1 and 2, the circuit board may expand due to environmental humidity, and in some cases, the position of the light emitting element array chip mounted on the circuit board may be varied. That is, in these optical printer heads disclosed in the patent documents 1 and 2, when an image is formed onto a recording paper by incorporating each of these optical printer heads into an image forming apparatus, the image formed onto the recording paper may be subject to distortion.

The invention aims at reducing positional variations of light emitting elements due to environmental humidity in an optical printer head.

Means for Solving the Problem

The invention relates to an optical printer head. The invention also relates to an image forming apparatus equipped with the optical printer head.

The optical printer head is provided with one or a plurality of light emitting element array units, each of which has a circuit board, a base member having a lower hygroscopic rate than the circuit board and supporting the circuit board, and a plurality of light emitting elements disposed on the base member and arranged along a main scanning direction on the base member.

Effects of the Invention

In the optical printer head of the invention, the plurality of light emitting elements are arranged on the base member having a lower hygroscopic rate than the circuit board. Therefore, the optical printer head is capable of reducing the influence of expansion due to environmental humidity than the case of arranging the plurality of light emitting elements on the circuit board. Hence, the optical printer head is capable of reducing the positional variations of the plurality of light emitting elements due to environmental humidity, thereby performing superior image formation in the image forming apparatus equipped with the optical printer head.

DESCRIPTION OF REFERENCE NUMERALS

Figure 1:
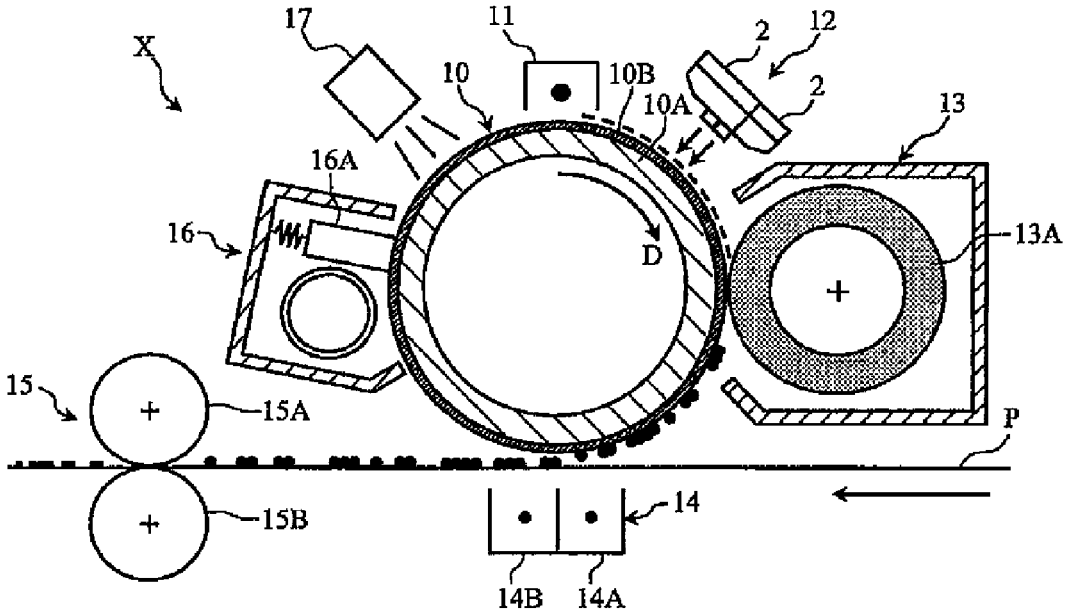
FIG. 1 is a sectional view showing the schematic structure of an example of an image forming apparatus according to the invention.

X . . . image forming apparatus
12 . . . optical printer head
3 . . . light emitting element array unit
30 . . . circuit board
30A . . . circuit
30Aa . . . connection pad

30Ab . . . circuit pad
30B . . . insulating layer
32 . . . driver IC
33 . . . base member
37A . . . hole portion
37B . . . hope portion (through hole)
4 . . . support member
5 . . . rod lens array (lens member)
6 . . . connecting means
61A, 61B . . . pin (inserting element)
M1, M2 . . . main scanning direction
S1, S2 . . . vertical-scanning direction

PREFERRED MODE FOR CARRYING OUT THE INVENTION

The image forming apparatus and the optical printer head according to the invention will be specifically described below with reference to the accompanying drawings.

An image forming apparatus X shown in FIG. 1 is provided with an electrophotographic photoreceptor 10, a charging device 11, an optical printer head 12, a developing device 13, a transfer device 14, a fixing device 15, a cleaning device 16, and a charge eliminating device 17.

The electrophotographic photoreceptor 10 is one on which an electrostatic latent image and a toner image based on image signals are formed, and is rotatable in a direction indicated by an arrow D. The electrophotographic photoreceptor 10 is one in which a photosensitive layer 10B is formed on the outer peripheral surface of a cylindrical substrate 10A.

The cylindrical substrate 10A, at least the surface thereof having electrical conductivity, is formed by, for example, aluminum or the like.

The photosensitive layer 10B has the structure in which a photoconductive layer composed of an inorganic semiconductor, such as amorphous silicon, or an organic semiconductor is laminated. When the light from the optical printer head 12 is irradiated to the photoconductive layer, the photosensitive layer 10B forms a predetermined latent image onto the photoconductive layer by rapidly lowering the specific resistance of the photoconductive layer. Alternatively, the photosensitive layer 10B may be provided with a carrier injection restricting layer for restricting carrier injection from the cylindrical substrate 10A, or a surface layer for protecting the surface of the electrophotographic photoreceptor 10.

The charging device 11 uniformly charges the surface of the electrophotographic photoreceptor 10 in positive polarity or negative polarity, depending on the kind of the photoconductive layer. The charged potential of the electrophotographic photoreceptor 10 is usually 200 to 1000 V.

The optical printer head 12 forms an electrostatic latent image onto the electrophotographic photoreceptor 10 by exposing the electrophotographic photoreceptor 10. The details of the optical printer head 12 will be described later.

The developing device 13 forms a toner image by developing the electrostatic latent image on the electrophotographic photoreceptor 10. The developing device 13 holds a developer and has a developing sleeve 13A.

The developer constitutes a toner image to be formed on the surface of the electrophotographic photoreceptor 10. The developer is frictionally charged in the developing device 13. As the developer, a two-component developer consisting of magnetic carrier and insulating toner, or a one-component developer consisting of magnetic toner can be used.

The developing sleeve 13A functions to transport the developer to a developing region between the electrophotographic photoreceptor 10 and the developing sleeve 13A.

In the developing device 13, the toner frictionally charged by the developing sleeve 13A is transported in the shape of a magnetic brush adjusted to a certain spike length. In the developing region between the electrophotographic photoreceptor 10 and the developing sleeve 13A, the electrostatic latent image is developed using the toner, thereby forming a toner image. When image formation is carried out by normal development, the charged polarity of the toner image is opposite polarity to the charged polarity of the surface of the electrophotographic photoreceptor 10. When image formation is carried out by reversal development, the charged polarity of the toner image is identical polarity to the charged polarity of the surface of the electrophotographic photoreceptor 10.

The transfer device 14 transfers the toner image onto a recording paper P supplied to a transfer region between the electrophotographic photoreceptor 10 and the transfer device 14, and has a transfer charger 14A and a separation charger 14B. In the transfer device 14, the back of the recording paper P (a non-recording surface) is charged with a reverse polarity to the toner image in the transfer charger 14A, so that the toner image is transferred onto the recording paper P by the electrostatic attractive force between the electric charge thus charged and the toner image. Further in the transfer device 14, at the same time as the transfer of the toner image, the back of the recording paper P is subject to alternating charging in the separation charger 14B, so that the recording paper P is quickly separated from the surface of the electrophotographic photoreceptor 10.

Alternatively, as the transfer device 14, transfer rollers can be used which are driven by the rotation of the electrophotographic photoreceptor 10, and disposed away from the electrophotographic photoreceptor 10 with a slight gap (normally not more than 0.5 mm) interposed therebetween. In this case, these transfer rollers are constructed to apply a transfer voltage that attracts the toner image on the electrophotographic photoreceptor 10 onto the recording paper P by, for example, a DC power supply. When these transfer rollers are used, a transfer agent separating device, such as the separation charger 14B, can be omitted.

The fixing device 15 fixes the toner image transferred onto the recording paper P, and has a pair of fixing rollers 15A and 15B. In the fixing device 15, the toner image is fixed onto the recording paper P by heat and pressure by passing the recording paper P between the pair of rollers 15A and 15B.

The cleaning device 16 removes the toner remaining on the surface of the electrophotographic photoreceptor 10, and has a cleaning blade 16A. In the cleaning device 16, the toner remaining on the surface of the electrophotographic photoreceptor 10 is scraped off and recovered by the cleaning blade 16A. The toner recovered by the cleaning device 16 may be recycled into the developing device 13.

The charge eliminating device 17 eliminates the surface charge of the electrophotographic photoreceptor 10. The charge eliminating device 17 is constructed to eliminate the surface charge of the electrophotographic photoreceptor 10 by, for example, light irradiation.

Figure 2:
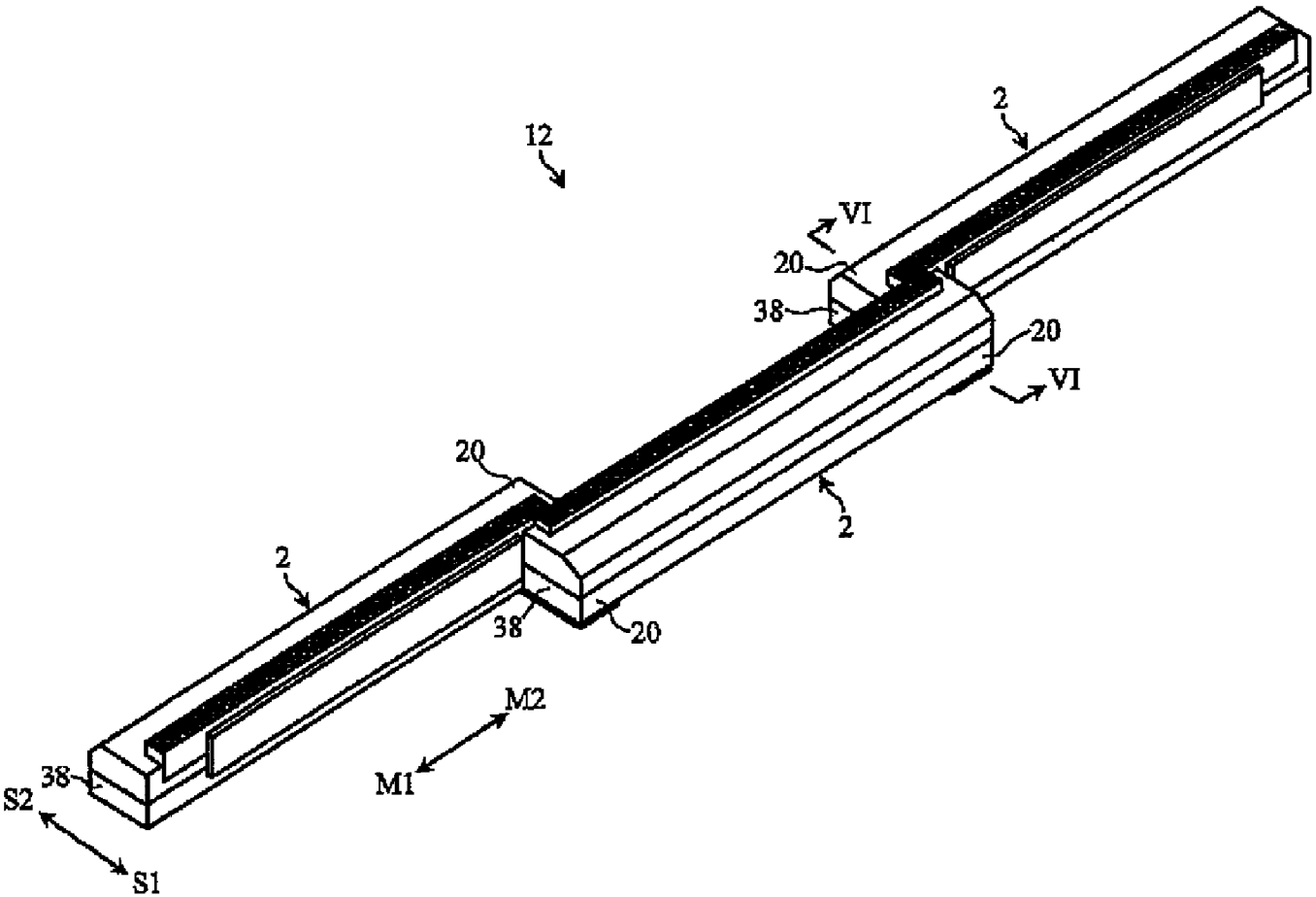
FIG. 2 is a perspective view showing an example of an optical printer head according to the invention.

As shown in FIG. 2, in the optical printer head 12, a plurality of head devices 2 are arranged along main scanning directions M1 and M2. The optical printer head 12 is formed by using the plurality of head devices 2, thus enabling image formation onto large recording papers, such as A0-size paper, while maintaining a high yield.

Figure 3:
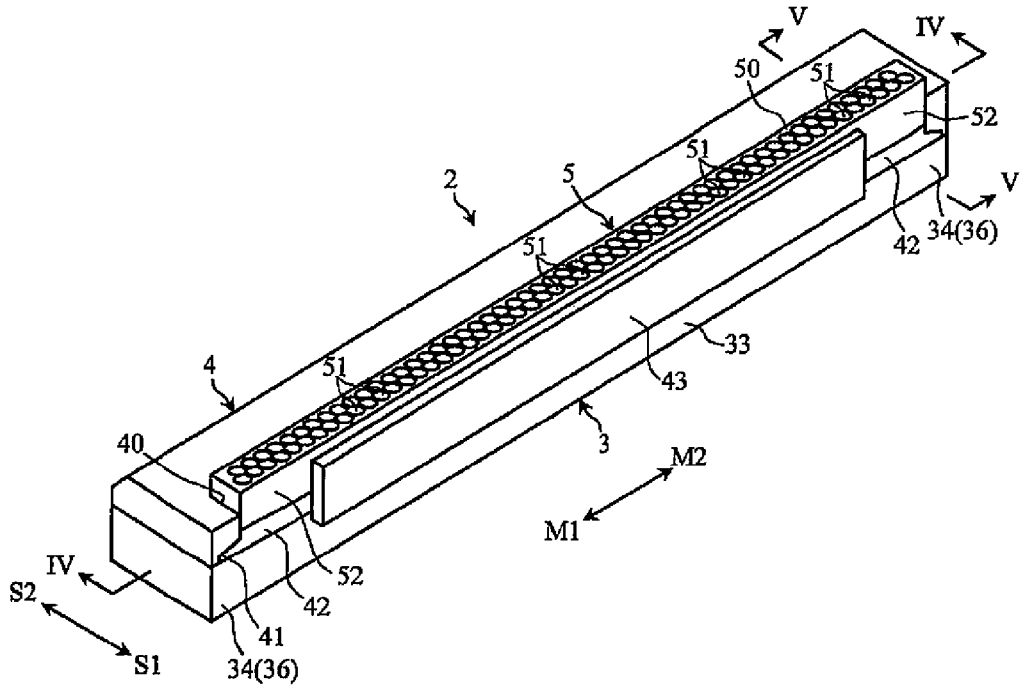
FIG. 3 is a perspective view of a head device in the optical printer head shown in FIG. 2.
Figure 4:
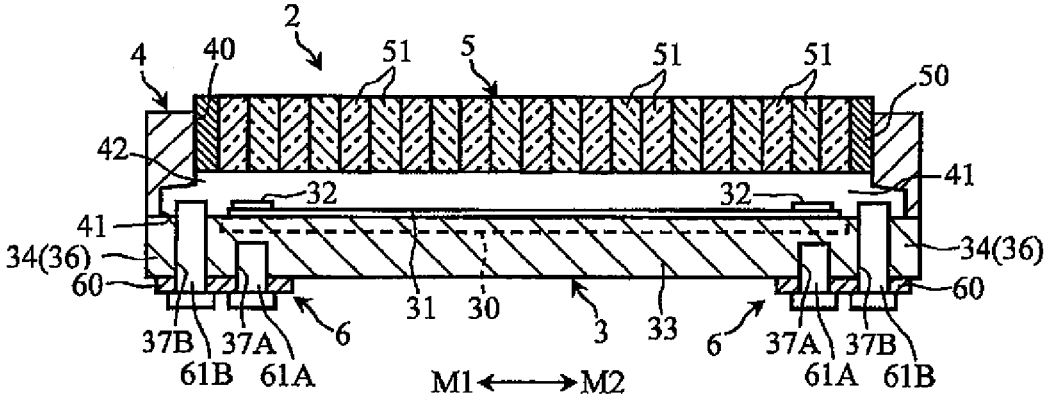
FIG. 4 is a sectional view taken along the line IV-IV in FIG. 3.
Figure 5:
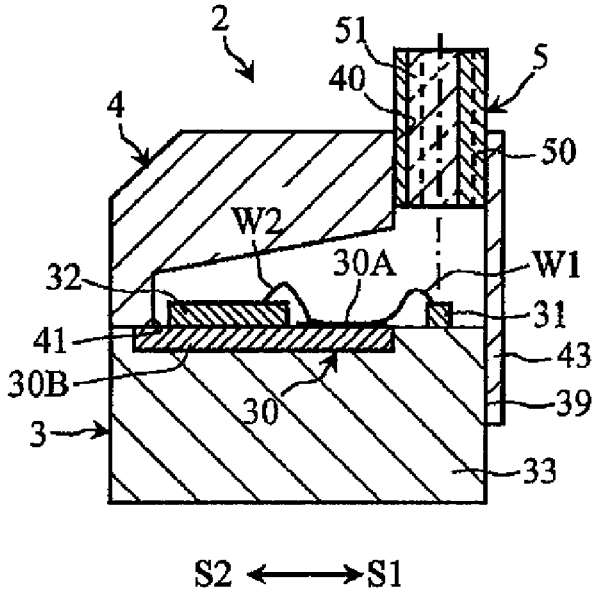
FIG. 5 is a sectional view taken along the line V-V in FIG. 3.
Figure 6:
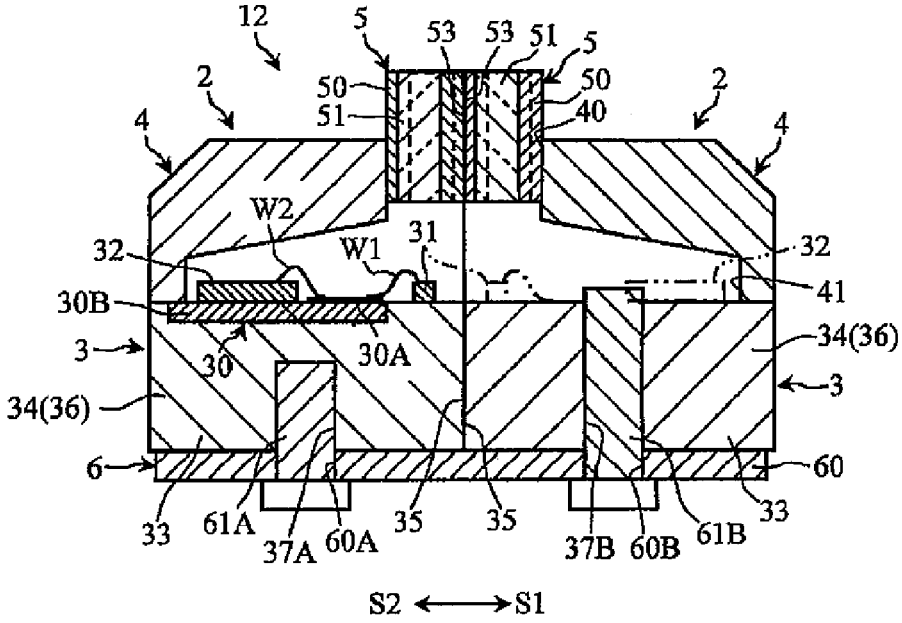
FIG. 6 is a sectional view taken along the line VI-VI in FIG. 2.
Figure 7:
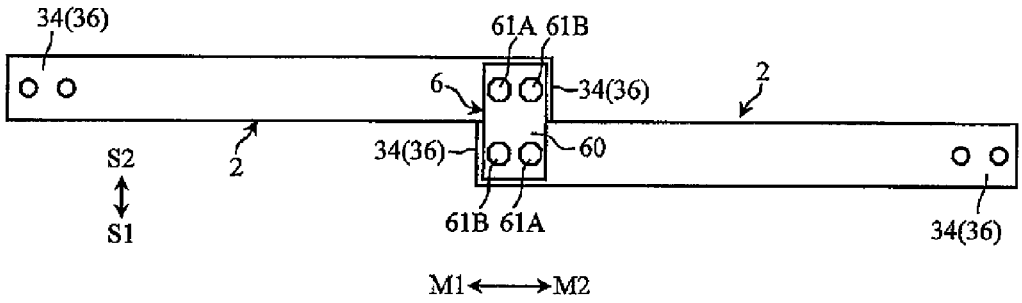
FIG. 7 is a bottom plan view showing essential parts of the optical printer head shown in FIG. 2.

The plurality of head devices 2 are arranged so that their respective end portions 20 in the main scanning directions M1 and M2 are overlapped with vertical-scanning directions (sub-scanning directions) S1 and S2. Each of these head devices 2 is provided with a light emitting element array unit 3, a support member 4 and a rod lens array 5, as shown in FIGS. 3 to 5. The adjacent head devices 2 are connected to each other through connecting means 6, as shown in FIGS. 6 and 7.

As shown in FIGS. 3 to 5, each of these light emitting element array units 3 is provided with a circuit board 30, one or a plurality of light emitting array chips 31, a pair of driver ICs 32, and a base member 33.

Figure 8:
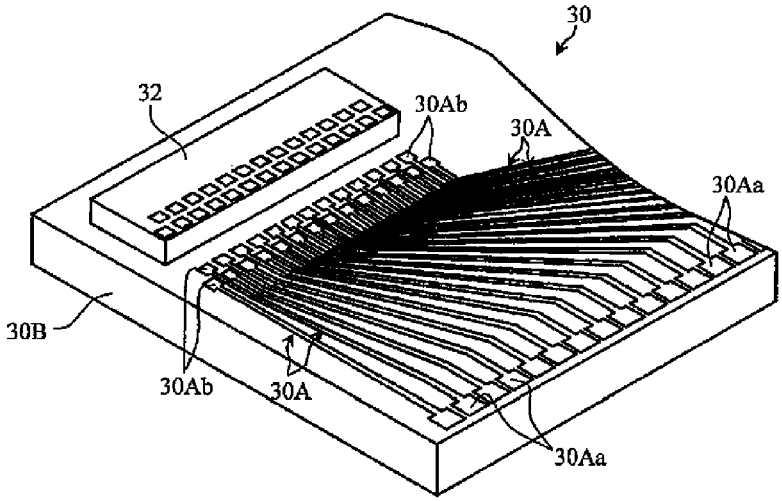
FIG. 8 is a perspective view showing essential parts of a circuit board in the optical printer head shown in FIG. 2.

As shown in FIG. 8, the circuit board 30 includes a circuit 30A and an insulating layer 30B, and has a higher hygroscopic rate than the base member 33 (refer to FIGS. 3 to 5) as a whole.

The circuit 30A is formed in a predetermined pattern by using a conductive material, and includes a connection pad 30Aa electrically connected to the electrode pad of the light emitting element array chip 31 (refer to FIGS. 5 and 6), and a circuit pad 30Ab electrically connected to the driver ICs 32.

The insulating layer 30B preferably has a higher hygroscopic rate than the base member 33 (refer to FIGS. 3 to 5), and is formed from, for example, epoxy resin, glass epoxy resin in which epoxy resin is impregnated into a glass cloth substrate, or glass.

As shown in FIGS. 5 and 6, the circuit board 30 is buried in the base member 33. A surface of the connection pad 30Aa (refer to FIG. 8) of the circuit 30A on the circuit board 30 is in substantially the same plane as a surface of the base member, on which the light emitting element array chip 31 is disposed. Of course it is not always necessary to bury the circuit board 30 into the base member 33 (refer to FIGS. 3 to 5).

Here, the hygroscopic rates of the circuit board 30 and the insulating layer 30B are expressed by the following equation 1:

$$\text{Hygroscopic rate (\%)}=(B-A)A\times 100 \qquad \text{[Equation 1]}$$

In the equation 1, A is a length measured immediately after baking the circuit board 30 and the insulating layer 30B at 150° C. for 60 minutes. In the equation 1, B is a length measured when the circuit board 30 and the insulating layer 30B are baked under the above conditions, and thereafter they are left in an environment where the temperature is 25° C. and the humidity is 50% for a week.

Figure 9:
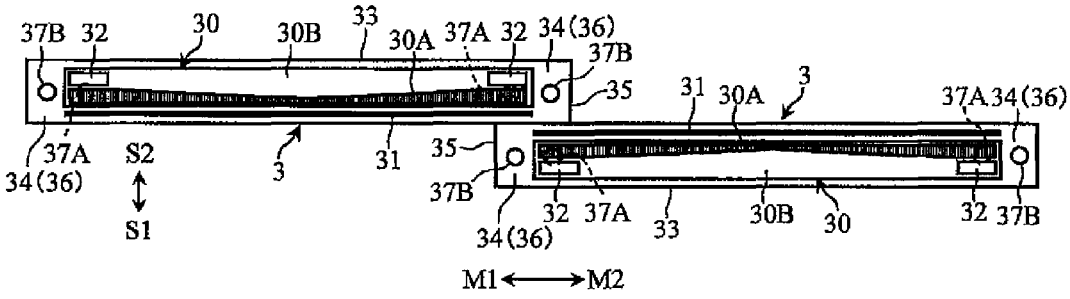
FIG. 9 is a plan view for explaining a light emitting element array unit in the optical printer head shown in FIG. 2.

As shown in FIGS. 5 and 9, in the light emitting element array chip 31, a plurality of light emitting elements are linearly arranged on a chip substrate along the main scanning directions M1 and M2, and arranged along the longitudinal direction of the circuit board 30 (the main scanning directions M1 and M2) at a position adjacent to the vertical-scanning directions S1 and S2 with respect to the circuit board 30 in the base member 33. A plurality of electrode pads is disposed on the chip substrate. Each of these electrode pads is electrically connected through a wire W1 to the corresponding connection pad 30Aa (refer to FIG. 8) on the circuit board 30. Therefore, the plurality of electrode pads are preferably arranged so that a plurality of wires W1 used in connection with the connection pads 30Aa on the circuit board 30 are substantially parallel to each other.

The plurality of light emitting elements is, for example, light emitting diodes, and arranged in a density of 600 dpi (dot per inch) in the main scanning directions M1 and M2. As the light emitting diodes, those formed by using, for example, a GaAs-based semiconductor material or the like can be employed. In this case, these light emitting elements may be formed in the inside of a chip substrate formed from a semiconductor material, such as GaAs and Si, by doping Al or P, etc. Alternatively, they may be formed by laminating a semiconductor layer on the top surface of the chip substrate formed from an insulating material such as sapphire, etc. In the former case, the chip substrate has electrical conductivity, and hence an insulating member is interposed between the base member 33 and the light emitting element array chip 31.

As shown in FIGS. 2 and 6, the plurality of head devices 2 are arranged so that their respective end portions 20 in the main scanning directions M1 and M2 are overlapped with the vertical-scanning directions S1 and S2. Therefore, as shown in FIG. 6, the adjacent light emitting element array units 3 are arranged so that side faces 35 of their end portions 34 are contactingly overlapped with each other. As a result, in the adjacent light emitting element array units 3, the pitch between the light emitting elements at a boundary portion (an overlapped portion) of the individual light emitting element array units 3 can be set substantially equal to the pitch between adjacent light emitting elements in the identical light emitting element array unit 3. Additionally, in the arrangement that the side faces 35 at the end portions 34 of the adjacent light emitting element array units 3 have face-to-face contact with each other, it is easy to perform positional adjustment between the light emitting element array units 3 when the optical printer head 12 is formed, thus achieving excellent workability when the light emitting element array units 3 are connected to each other by using the connecting means 6.

As shown in FIGS. 5, 6 and 9, the pair of driver ICs 32 control the amount of current flowing through the light emitting elements by driving the light emitting elements in the light emitting element array chips 31, based on electric signals from the exterior of the optical printer head 12. These driver ICs 32 are arranged at positions corresponding to both end portions of a plurality of rows of light emitting elements (both end portions of the circuit board 30) on the circuit board 30, and electrically connected through a wire W2 to the circuit 30A on the circuit board 30. The arrangement of these driver ICs 32 on the circuit board 30 eliminates the possibility that when the end portions 34 of the adjacent light emitting element array units 3 are overlapped with each other in the vertical-scanning directions S1 and S2, these driver ICs 32 exist between the rows of light emitting elements at their respective end portions 34. This prevents the rows of the light emitting elements of the adjacent light emitting element array units 3 from being far apart in the vertical-scanning directions S1 and S2.

Of course, when these driver ICs 32 are arranged on the circuit board 30, these driver ICs 32 may be flip-chip mounted by a conductive material such as solder and gold. That is, in the structure where these driver ICs 32 are mounted on the circuit board 30, both of wire bonding type and flip chip type can be selected as these driver ICs 32, thereby increasing the degree of freedom in design.

Further, the nonuniformity of temperature distribution of the light emitting element rows can be improved by arranging these driver ICs 32 at the positions corresponding to both end portions of the plurality of light emitting element rows (both end portions of the circuit board 30). That is, when causing the plurality of light emitting elements to emit light, the middle part in the plurality of rows of light emitting elements is more susceptible to temperature rise due to the heat generated during the light emission from these light emitting elements than the end portions thereof. In contrast, by arranging these driver ICs 32 at the positions corresponding to both end portions of the plurality of rows of light emitting elements (both end portions of the circuit board 30), the heat generated by these driver ICs 32 can be used to increase the temperature in the vicinity of both end portions of the plurality of rows of light emitting elements where there is a tendency to have a low temperature. This improves the nonuniformity of the temperature distribution during driving in the plurality of rows of light emitting elements. Therefore, when the optical printer head 12 is used by incorporating it into an image forming apparatus X, the occurrence of a temperature distribution in the plurality of light emitting elements can be reduced, thereby reducing the occurrence of concentration nonuniformity caused by the temperature distribution.

As shown in FIGS. 4, 6 and 9, the base member 33 supports the circuit board 30 and the light emitting element array chip 31, and has a lower hygroscopic rate than the circuit board 30 as a whole.

Like the circuit board 30 and the insulating layer 30B, the hygroscopic rate of the base member 33 is defined by the above equation 1, based on a length obtained immediately after baking, and a length obtained after leaving under the predetermined conditions.

Examples of the material mainly constituting the base member 33 include metal materials such as aluminum, copper, magnesium, nickel, iron and SUS. By forming the base member 33 from a material having high thermal conductivity, such as aluminum and SUS, the function as a heat radiating plate can be imparted to the base member 33, thereby suitably releasing the heat generated by the light emitting element array chips 31 to the exterior.

As shown in FIGS. 6, 7 and 9, a pair of hole portions 37A and 37B are formed at both end portions 36 of the base member 33, respectively. Pins 61A and 61B are inserted into these hole portions 37A and 37B in the connecting means 6 described later. The diameters of these hole portions 37A and 37B correspond to the diameters of these pins 61A and 61B. For example, their diameters are set to not less than 1.0 mm nor more than 5.0 mm.

The hole portion 37A is formed inwardly from the hole portion 37B in the main scanning directions M1 and M2, and formed non-piercingly at a position corresponding to the end portion of the circuit board 30. On the other hand, the hole portion 37B is formed outwardly from the hole portion 37A and the light emitting element array chip 31 in the main scanning directions M1 and M2, and formed as a through hole. These hole portions 37B formed at both ends portions of the base member 33, respectively, are formed so that the straight lines connecting their respective centers are parallel or substantially parallel to the main scanning directions M1 and M2 (the plurality of rows of light emitting elements).

The hole portions 37B are formed as through holes located outside of the light emitting array chips 31, and the straight lines connecting these hole portions 37B are arranged parallel or substantially parallel to the rows of the light emitting element array chips 31 (the light emitting elements), namely the main scanning directions M1 and M2. Thereby, when the light emitting element array chips 31 are mounted onto the base member 33, these light emitting element array chips 31 can be positioned on the base member 33 by using these hole portions 37B as marks. Thus, these hole portions 37B improve the productivity of the optical printer head 12.

In these light emitting element array units 3, the light emitting element array chips 31 are arranged on the base member 33 having a lower hygroscopic rate than the circuit board 30. Hence, the light emitting element array units 3 is subject to a smaller amount of change in the length thereof in the longitudinal direction of the base member 33 (the main scanning directions M1 and M2) due to environmental humidity than the circuit board 30. This enables the light emitting element array units 3 to reduce the positional variations of the light emitting element array chips 31 (the light emitting elements), thereby contributing to superior image formation in the image forming apparatus X.

Although the base member 33 has a lower hygroscopic rate than the circuit board 30, depending on the material constituting the circuit board 30 and that of the base member 33, the base member 33 can have a larger coefficient of thermal expansion than the circuit board 30. Even so, the light emitting element array chips 31 are preferably mounted on the base member 33 supporting the light emitting element array chips 31 in order to prevent the deviation of the light emitting elements. That is, even if the base member 33 is thermally expanded or thermally shrunk under environmental temperature change, these light emitting elements will basically return to their respective original positions when the environmental temperature returns to its initial value. However, in the case where with increasing environmental humidity, a high water content is absorbed by the circuit board 30, causing expansion of the circuit board 30, it is difficult to completely release the water content absorbed by the circuit board 30 to the exterior even if the environmental humidity returns to its original value. Consequently, the circuit board 30 remains expanded than it was before the humidity rises. When the humidity further rises in this state, the circuit board 30 will correspondingly further expand. In the order of priority of characteristics required for the base member 33, its low hygroscopic property is therefore higher than its small coefficient of thermal expansion. Hence in the present preferred embodiment, the light emitting element array chips 31 are arranged on the base member 33 having a lower hygroscopic rate than the circuit board 30.

As described above with reference to FIG. 2, in the optical printer head 12, the end portions 20 of the plurality of head devices 2 are arranged so as to overlap the vertical-scanning directions S1 and S2. In the base members 33 of the adjacent light emitting element array units 3, their respective end faces 38 in the main scanning directions M1 and M2 are dislocated in the vertical-scanning directions S1 and S2 without any face-to-face contact therebetween. Thus, these end faces 38 of the base member 33 are arranged to avoid mutual contact, thereby minimizing thermal stress generated between the adjacent base members 33, even if these base members 33 are subject to thermal expansion or thermal shrinkage due to a large environmental temperature change. This also minimizes the positional variations of the light emitting element array chips 31.

As shown in FIGS. 3 to 6, the support member 4 supports the rod lens array 5, and has an upper opening 40, a lower opening 41, an end opening 42 and a positioning wall 43.

The upper opening 40 is closed by the rod lens array 5, whereas the lower opening 41 is closed by the light emitting element array unit 31 (the base member 33). Therefore, a closed space is formed between the rod lens array 5 and the light emitting element array unit 31.

The end opening 42 exposes the end portions 52 in the main scanning directions M1 and M2 in the rod lens array 5, and is continuous with the upper opening 40 and the lower opening 41 (refer to FIG. 3).

The positioning wall 43 is used for positioning between the support member 4 and the base member 33 when mounting the support member 4 onto the base member 33. The positioning wall 43 is contactable with the side face 39 of the base member 33 when the support member 4 is mounted onto the base member 33 (refer to FIG. 5).

The above support member 4 may be any one of those whose entirety is integrally formed with a single member, and those constructed by combining a plurality of members. Examples of the material constituting the support member 4 include metal materials such as iron, aluminum and SUS, or resin materials such as PPS (poly phenylene sulfide) resin, ABS (acrylonitrile butadiene styrene) resin and PC (polycarbonate) resin. Like the base member 33, the support member 4 preferably has a lower hygroscopic rate than the circuit board 30 as a whole. This enables a reduction in the expansion of the support member 4 due to environmental humidity, thereby reducing the occurrence of a deviation between the rod lens array 5 and the light emitting element array chip 31 (the light emitting element). Like the circuit board 30, the insulating layer 30B and the base member 33, the hygroscopic rate of the support member 4 is defined by the above equation 1, based on a length obtained immediately after baking, and a length obtained after leaving under the predetermined conditions. As the material having a lower hygroscopic rate used for the support member 4, there are, for example, aluminum and SUS. When the support member 4 is formed by using a material having a high optical reflectance, however, the inner surface of the support member 4 is preferably subjected to the process for reducing optical reflection.

As shown in FIGS. 3 to 6 and 10, the rod lens array 5 introduces the light emitted from the light emitting element array chips 31 (the light emitting elements) onto the surface of the electrophotographic photoreceptor 10 (refer to FIG. 1) in the image forming apparatus X, and is supported on the base member 33 with the support member 4 interposed therebetween. In the rod lens array 5, a plurality of rod lenses are held by a lens holder 50.

The individual rod lenses 51 are refractive index distribution type rod lenses and function as an erecting equal-magnification optical system that irradiates and images the light emitted from the light emitting element array chips 31 (the light emitting elements) with equal magnification onto the electrophotographic photoreceptor 10 (refer to FIG. 1) in the image forming apparatus X. The plurality of rod lenses 51 are disposed substantially immediately above the light emitting element array chips 31 (the light emitting elements), and arranged in two rows of zigzag pattern in parallel with the main scanning directions M1 and M2, respectively.

Figure 11:
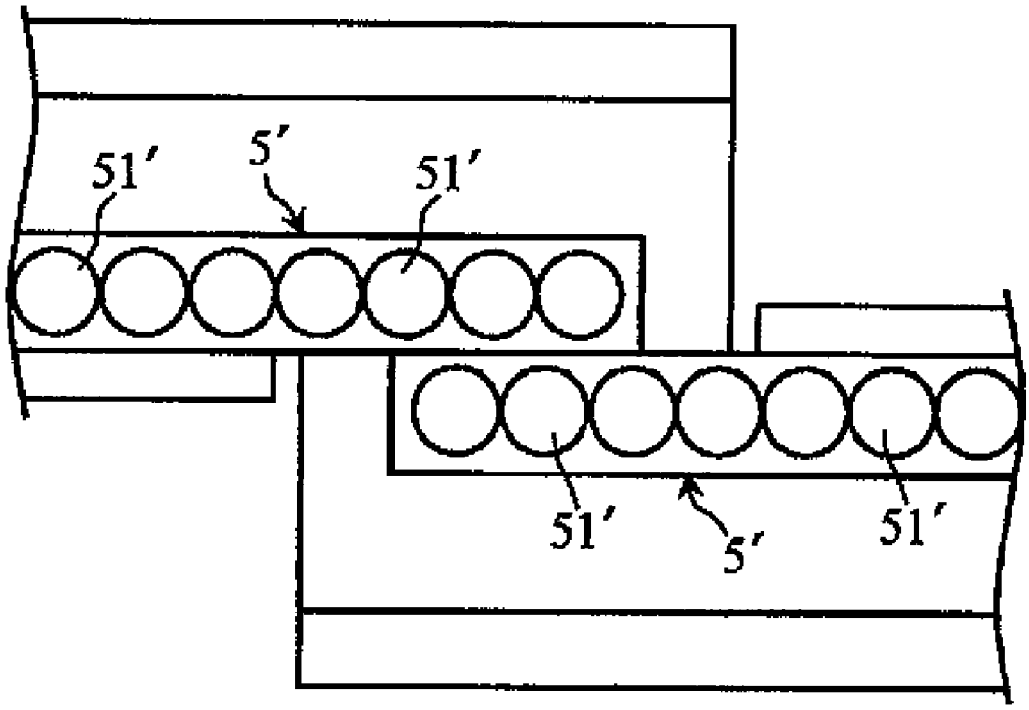
FIG. 11 is a plan view corresponding to FIG. 10 in order to explain other example of a lens array in the optical printer head.

Of course, the plurality of rod lens 51 may be arranged in three or more rows of zigzag pattern. Alternatively, like rod lens arrays 5' shown in FIG. 11, a plurality of rod lenses 51' may be arranged linearly in a row.

Figure 10:
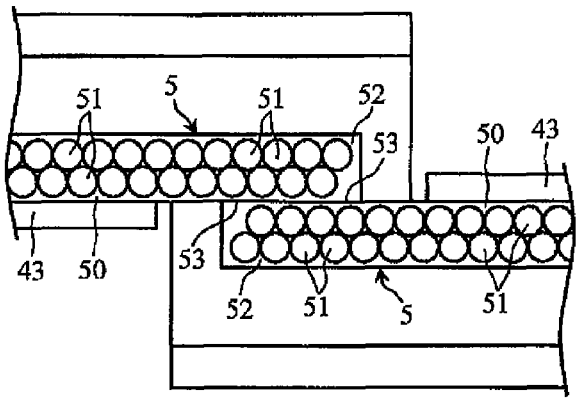
FIG. 10 is a plan view showing the surroundings of the connection portions of the head device in the optical printer head shown in FIG. 2.

As shown in FIG. 3, the end portions 52 of each of the rod lens arrays 5 are exposed at the end openings 42 of the support member 4. As shown in FIGS. 6 and 10, the end portions 52 of the rod lens arrays 5 of the adjacent head devices 2 (the light emitting element array units 3) are in contact with each other. As shown in FIGS. 4 and 5, each of these rod lens arrays 5 is arranged so that the side face 53 lies in substantially the same plane as the side face 39 of the base member 33.

Here, the end portions 52 of the rod lens arrays 5 in the adjacent head devices 2 (the light emitting element array units 3) are adapted for mutual contact, thereby minimizing the amount of deviation in the vertical-scanning directions S1 and S2 between the adjacent rod lens arrays 5, respectively. As a result, the amount of data necessary for driving the light emitting elements can be decreased, thus contributing to cost reduction in the entire image forming apparatus X owing to the decrease in the amount of memory. That is, the width of the rod lens array 5 in the vertical-scanning directions S1 and S2 is usually larger than the width of the light emitting element array chip 31 in the vertical-scanning directions S1 and S2, and hence in the design thereof, the position of the light emitting element array chip 31 is determined to the position of the rod lens array 5. Therefore, by minimizing the amount of deviation of the rod lens array 5 in the vertical-scanning directions S1 and S2, the amount of deviation of the light emitting element array chip 31 in the vertical-scanning directions S1 and S2 can be inevitably minimized. On the other hand, when driving these light emitting elements, they are required to emit light at different timings so as to cancel out the amount of deviation of the light emitting element array chip 31 in the vertical-scanning directions S1 and S2. Accordingly, the amount of deviation of light emitting timing of the light emitting elements becomes larger with increasing the amount of deviation of the light emitting element array chip 31, and the amount of data necessary for control will be correspondingly increased. Therefore, by minimizing the amount of deviation of the rod lens array 5 in the vertical-scanning directions S1 and S2, the amount of data necessary for control the light emitting elements can be decreased. As a result, the amount of memory of the image forming apparatus X can be decreased, thus contributing to cost reduction in the entire image forming apparatus X.

Further, in the structure in which the side face 53 at the end portions 52 of the rod lens array 5 is arranged on substantially the same plane as the side face 39 of the base member 33, it is easy to perform positional adjustment between the rod lens array 5 and the base member 33. On the other hand, the light emitting element array chip 31 (the light emitting element) is mounted onto the base member 33, and hence the easy positional adjustment between the rod lens array 5 and the base member 33 facilitates the positional adjustment between the rod lens array 5 and the light emitting element array chip 31 (the light emitting element), thereby improving the productivity of the optical printer head 12.

As shown in FIGS. 4, 6 and 7, the connecting means 6 connects the adjacent light emitting element array units 3 to each other, and includes the connecting member 60 and pins 61A and 61B.

The connecting member 60 is fixed to end portions 36 of the base member 33 in each of the adjacent light emitting element array units 3, with these pins 61A and 61B interposed therebetween. The connecting member 60 has through holes 60A and 60B, into which these pins 61A and 61B are inserted, respectively. Examples of the material constituting the connecting member 60 include high rigidity materials such as iron, aluminum and ceramics. Particularly, by forming the connecting member 60 with a material having a smaller coefficient of thermal expansion than the base member 33, when the base member 33 tends to expand or shrink under environmental temperature change, the connecting member 60 can suitably restrict deformation of the base member 33.

These pins 61A and 61B fix the connecting member 60 to the end portions 36 of the base member 33 in each of the adjacent light emitting element array units 3 in order to connect the adjacent light emitting element array units 3 to each other. The pin 61A is inserted into the through hole 60A of the connecting member 60 and the hole portion 37A of the base member 33. The pin 61B is inserted into the through hole 60B of the connecting member 60 and the hole portion 37B of the base member 33.

These pins 61A and 61B may be, of course, integrated with the connecting member 60. Alternatively, any other known members, such as male screws, may be used instead of these pins 61A and 61B.

The connecting means 6 fixes the adjacent head devices 2 (the light emitting element units 3) to the end portions 36 of the base member 33. Therefore, when the base member 33 tends to expand or shrink under environmental temperature change, the expansion thereof or the shrinkage thereof is suitably reduced by the connecting means 6 (the connecting member 60). As a result, the positional variations of the light emitting elements can be reduced, thus contributing to superior image formation in the image forming apparatus X.

Next, a method of manufacturing the optical printer head 12 will be described.

Firstly, the circuit board 30, the light emitting element array chip 31, the driver ICs 32, the base member 33, the support member 4 and the rod lens arrays 5 are prepared. These members are manufactured in the forms described earlier with reference to the drawings by any known method, respectively.

Next, the light emitting element array unit 2 is formed by assembling the circuit board 30, the light emitting element array chip 31, the driver ICs 32 and the base member 33. The assembling of these members is also basically carried out by any known method.

Hereat, the light emitting element array chip 31 is mounted onto the base member 33 so that the straight lines connecting the hole portions 37B with each other are parallel or substantially parallel to the rows of the light emitting elements. On this occasion, the positioning of the light emitting element array chip 31 with respect to the base member 33 is carried out with these hole portions 37B as reference, thereby facilitating the positioning of the light emitting element array chip 31.

Subsequently, the support member 4 is mounted onto the light emitting element array chip 31, and the rod lens array 5 is inserted into the upper opening 40 of the support member 4 and then fixed with adhesive or the like. Thus, the head device 2 is completed. On this occasion, by bringing the positioning wall 43 of the support member 4 into contact with the side face 39 of the base member 33, the support member 4 and the base member 33 can be properly positioned. Further, the rod lens array 5 is fixed to the upper opening 40 of the support member 4, thereby achieving a proper positioning of the rod lens array 5 with respect to the support member 4. Consequently, the rod lens array 5 is properly positioned with respect to the base member 33, and also the light emitting element array chip 31 (the light emitting element) mounted onto the base member 33. Therefore, by disposing the positioning wall 43 on the support member 4, it is extremely easy to carry out the positioning between the rod lens array 5 and the light emitting element array chip 31 (the light emitting element).

Subsequently, the end portions 20 of a plurality of head devices 2 are overlapped with each other by using the connecting means 6, thereby connecting these head devices 2 in a zigzag pattern. The connection of the plurality of head devices 2 is carried out by positioning the connecting member 60 of the connecting means 6 so as to sequentially cover their respective end portions 20 (the end portions 36 of the base member 33), and then inserting the through holes 60A and 60B of the connecting member 60 and the hole portions 37A and 37B of the base member 33. Thus, the optical printer head 12 is formed by arranging the plurality of head devices 2 in the zigzag pattern and then connecting them to each other.

The image forming apparatus X incorporating the above optical printer head 12 causes a plurality of light emitting elements to individually and selectively emit light, based on the image data from the exterior of the optical printer head 12. The plurality of light emitting elements may be time-division driven in order to simultaneously drive the light emitting elements in the light emitting element array unit 3 having the same positions in the vertical-scanning directions S1 and S2, and also drive at different timings the light emitting elements in the light emitting element array units 3 having different positions in the vertical-scanning directions S1 and S2.

The lights from the plurality of light emitting elements are irradiated and imaged through the rod lens 51 onto the surface of the photosensitive layer 10B of the electrophotographic photoreceptor 10, so that a predetermined electrostatic latent image is formed on the surface of the photosensitive layer 10B. The electrostatic latent image formed on the electrophotographic photoreceptor 10 (the photosensitive layer 10B) is then developed into a toner image by the developing device 13. The toner image is transferred onto the recording paper P by the transfer device 14, and thereafter fixed by the fixing device 15, so that a predetermined image is formed on the recording paper P. After the toner image is transferred onto the recording paper P, the toner remaining on the surface of the electrophotographic photoreceptor 10 is removed by the cleaning device 16, and the surface charge of the electrophotographic photoreceptor 10 is eliminated by the charge eliminating device 17.

The invention is not to be considered to be limited by the foregoing preferred embodiment, and various changes, improvements and the like can be made thereto without departing from the spirit or scope of the present invention.

Although in the foregoing preferred embodiment, for example, the optical printer head using the light emitting diodes as light emitting elements has been described, the invention is also applicable to EL heads, plasma dot heads, fluorescent heads, or optical printer heads using a liquid crystal shutter and a PLZT (lead lanthanum zirconate titanate) shutter.

The invention is also applicable to an optical printer head in which a plurality of light emitting element array units are arranged linearly, or an optical printer head provided with a light emitting element array unit.

Further, the invention is not limited to the image forming apparatus employing the electrophotographic system and is also applicable to an image forming apparatus that forms images onto a photosensitive medium, such as photosensitive paper, by irradiating light onto the photosensitive medium.

The invention claimed is:

1. An optical printer head comprising one or a plurality of light emitting element array units, each of which comprises a circuit board, a base member having a lower hygroscopic rate than the circuit board and supporting the circuit board, and a plurality of light emitting element disposed on the base member and arranged along a main scanning direction on the base member, wherein the circuit board has a connection pad electrically connected to the plurality of light emitting elements; and a surface of the connection pad on the circuit board is in substantially the same plane as a surface of the base member, on which the plurality of light emitting elements is disposed.

2. The optical printer head according to claim 1, wherein the plurality of light emitting element array units are arranged along the main scanning direction so that individual end portions in adjacent light emitting element array units are overlapped with each other in a vertical-scanning direction.

3. The optical printer head according to claim 2, further comprising connecting means connecting the adjacent light emitting element array units to each other.

4. The optical printer head according to claim 3, wherein the base member has a hole portion; and the connecting means includes an inserting element inserted into the hole portion.

5. The optical printer head according to claim 4, wherein the hole portion includes a pair of through holes extending through the base member and are arranged at both end portions in the main scanning direction on the base member; and the pair of through holes are formed so that horizontal straight lines connecting respective centers of the through holes are substantially parallel to the main scanning direction.

6. The optical printer head according to claim 3, wherein the coefficient of thermal expansion of a material mainly constituting the connecting means is smaller than the coefficient of thermal expansion of a material mainly constituting the base member.

7. The optical printer head according to claim 2, further comprising:

a lens member for introducing lights emitted from the plurality of light emitting elements into an irradiation area; and a support member enabling the lens member to be supported on the base member, wherein the individual lens members of adjacent light emitting element array units in the main scanning direction are in contact with each other in a condition that end portions of the lens members in the vertical-scanning direction are overlapped.

8. The optical printer head according to claim 1, further comprising:

a lens member for introducing lights emitted from the plurality of light emitting elements into an irradiation area; and a support member enabling the lens member to be supported on the base member.

9. The optical printer head according to claim 8, wherein the support member has a lower hygroscopic rate than the circuit board.

10. The optical printer head according to claim 8, wherein a side face of the lens member is in substantially the same plane as a side face of the base member.

11. The optical printer head according to claim 1, further comprising a pair of driver ICs arranged at positions corresponding to both end portions in a row of the plurality of light emitting elements, respectively.

12. The optical printer head according to claim 11, wherein the pair of driver ICs are arranged on the circuit board and electrically connected to the plurality of light emitting elements with the circuit board interposed therebetween.

13. The optical printer head according to claim 1, wherein a material mainly constituting the base member has higher thermal conductivity than a material mainly constituting the circuit board.

14. An image forming apparatus equipped with an optical printer head according to claim 1.

* * * * *